US010297409B2

(12) United States Patent
Naiman

(10) Patent No.: US 10,297,409 B2
(45) Date of Patent: May 21, 2019

(54) METHOD FOR OPERATING A CIRCUIT BREAKER AND CIRCUIT BREAKER

(71) Applicant: Siemens Aktiengesellschaft, München (DE)

(72) Inventor: Pavel Naiman, Letohrad (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 87 days.

(21) Appl. No.: 14/970,606

(22) Filed: Dec. 16, 2015

(65) Prior Publication Data

US 2016/0211104 A1 Jul. 21, 2016

(30) Foreign Application Priority Data

Jan. 20, 2015 (EP) ..... 15151783

(51) Int. Cl.

| | |
|---|---|
| ***H01H 77/10*** | (2006.01) |
| ***H01H 71/52*** | (2006.01) |
| ***H01H 71/50*** | (2006.01) |
| ***H01H 71/10*** | (2006.01) |

(52) U.S. Cl.

CPC ..... *H01H 71/52* (2013.01); *H01H 71/1054* (2013.01); *H01H 71/505* (2013.01); *H01H 71/525* (2013.01); *H01H 71/527* (2013.01); *H01H 77/105* (2013.01); *H01H 2205/002* (2013.01)

(58) Field of Classification Search

CPC ..... H01H 71/528; H01H 71/505; H01H 3/20
See application file for complete search history.

(56) References Cited

U.S. PATENT DOCUMENTS

| | | | | |
|---|---|---|---|---|
| 6,437,670 | B1 * | 8/2002 | Castonguay ..... | H01H 71/2418 335/16 |
| 2002/0050888 | A1 | 5/2002 | Fujita et al. | |
| 2004/0027217 | A1 | 2/2004 | Fujita et al. | |
| 2005/0140479 | A1 | 6/2005 | Dorn et al. | |
| 2011/0090031 | A1 | 4/2011 | Paek | |

FOREIGN PATENT DOCUMENTS

| | | |
|---|---|---|
| FR | 2940511 A1 | 6/2010 |
| WO | WO 2010/076512 | 7/2010 |

* cited by examiner

*Primary Examiner* — Felix O Figueroa
(74) *Attorney, Agent, or Firm* — Harness, Dickey & Pierce, P.L.C.

(57) ABSTRACT

A method is disclosed for operating a circuit breaker, the circuit breaker. The circuit breaker includes an operating lever, a latching mechanism and an electrical contact system with a movable contact and a fixed contact. The operating lever is movable into an ON-position and an OFF-position. Further, the operating lever is mechanically connected via the latching mechanism to the contact system such that when the operating lever is in its OFF-position, the contacts of the electrical contact system are opened and when the operating lever is in its ON-position, the contacts of the electrical contact system are closed. Further, such a circuit breaker is also disclosed.

8 Claims, 2 Drawing Sheets

METHOD FOR OPERATING A CIRCUIT BREAKER AND CIRCUIT BREAKER

PRIORITY STATEMENT

The present application hereby claims priority under 35 U.S.C. § 119 to European patent application number EP15151783.6 filed Jan. 20, 2015, the entire contents of which are hereby incorporated herein by reference.

FIELD

At least one embodiment of the present invention is generally relates to a method for operating a circuit breaker. More specifically, it relates to a method for operating a circuit breaker comprising an operating lever, a latching mechanism and an electrical contact system with a movable contact and a fixed contact, wherein the operating lever is movable into an ON-position and an OFF-position, wherein further the operating lever is mechanically connected via the latching mechanism to the contact system such that when the operating lever is in its OFF-position the contacts of the electrical contact system are opened and that when the operating lever is in its ON-position, the contacts of the electrical contact system are closed.

Further, at least one embodiment of the present invention is generally relates to a circuit breaker, and more specifically to a circuit breaker comprising an operating lever, a latching mechanism and an electrical contact system with a movable contact and a fixed contact, wherein the operating lever is movable into an ON-position and an OFF-position, wherein further the operating lever is mechanically connected via the latching mechanism to the contact system such that when the operating lever is in its OFF-position, the contacts of the electrical contact system are opened, that when the operating lever is in its ON-position, the contacts of the electrical contact system are closed.

BACKGROUND

In modern technical applications, circuit breakers are commonly used. Especially, circuit breakers can be used to circuit switching of high currents and powers respectively, for instance a circuit switching of currents as high as 70 kA and even higher. It is known to equip such circuit breakers with safety devices such as for instance an overload protection and/or a short-circuit protection and the according trigger switches. The overall safety during the usage of high electrical currents and/or powers can therefore be improved by a usage of such circuit breakers.

Modern circuit breakers generally comprise an operating lever for a manipulation by the operator, in most cases movable at least between an OFF-position and an ON-position. Internally, the switching of the electrical current is achieved by a contact system, the contact system usually comprising one or more pairs of fixed and movable contacts. A latching mechanism is provided in between, mechanically connected both to the operating handle and the contact system. Therefore, a manipulation of the operating lever by the operator results in a change in the contact system, for instance, a change of the position of the operating between its OFF-position and its ON-position results in a closing of the contacts of the contact system.

During the movement of the operating handle into its ON-position, in addition to the closing of the contacts of the contact system also an arming of the protection system(s) in the circuit breaker is necessary. Especially after the occurrence of a tripping incident, for instance an overcurrent or a short-circuit, this arming needs a reset of the circuit breaker, especially of the latching mechanism of the circuit breaker. In such a reset, especially of the latching mechanism, also the normal operation of the circuit breaker, e.g. induced by switching the operating lever from its OFF-position in its ON-position, can be prepared. Without a reset of the latching mechanism, the latching mechanism cannot be activated in a subsequent movement of the operating lever in its ON-position and the contact system of the circuit breaker cannot be closed and in addition the protection systems of the circuit breaker cannot be armed.

If a circuit breaker is switched on and its operating handle is accordingly moved into the ON-position, all movements of the latching mechanism and especially of the contacts of the electrical contact system have to be stopped at the end of the switching-on procedure. Especially an immediate activation of any armed safety device has to be prohibited. An unintentional interruption of the flow of current through the circuit breaker can for instance lead to a damage of a consumer load in the downstream electrical circuit.

One possible solution according to the state of the art is to disable the safety devices at a short period at the beginning of the operation of the circuit breaker. To hinder an unintentional triggering of a safety device, it is further known in circuit breakers according to the state of the art to provide for instance strong springs to solve the aforementioned issue. However, these stronger springs can lead to higher releasing forces for the safety devices. The overall safety for such circuit breakers could therefore be decreased. It is known in the state of the art to use longer lever-arms for the safety devices to solve this issue, but this leads to a larger size of the circuit breakers. Therefore, small and compact circuit breakers cannot be provided.

SUMMARY

At least one embodiment of the present invention involves solving the aforesaid problems and drawbacks, at least partly. In particular, at least one embodiment of the present invention provides a method for operating a circuit breaker and a circuit breaker, which allow a safe operation and a more compact circuit breaker design in an easy and cost efficient way.

At least one embodiment is directed to a method for operating a circuit breaker and/or by a circuit breaker. Further features and details of the present invention result from the claims, the description and the drawings. Features and details discussed with respect to the method for operating a circuit breaker can also be applied to the circuit breaker and vice versa, if of technical sense.

According to a first aspect of an embodiment of the invention, a method is disclosed for operating a circuit breaker. In an example embodiment of the method, the circuit breaker includes an operating lever, a latching mechanism and an electrical contact system with a movable contact and a fixed contact, wherein the operating lever is movable into an ON-position and an OFF-position, wherein further the operating lever is mechanically connected via the latching mechanism to the contact system such that when the operating lever is in its OFF-position the contacts of the electrical contact system are opened and that when the operating lever is in its ON-position the contacts of the electrical contact system are closed. The method according to an embodiment of the invention comprises:

a) moving the operating lever in its ON-position, b) transferring the movement of the operating lever via the latching mechanism to the contact system by moving a connecting device of the latching mechanism mechanically directly connected to the contact system in a first direction and thereby moving the movable contact, c) reaching the ON-position of the operating lever and closing the contacts of the contact system, and d) inhibiting a movement of the connecting device in a second direction different to the first direction.

BRIEF DESCRIPTION OF THE DRAWINGS

The present invention is described with respect to the accompanied figures. The figures show schematically.

Figure 1:
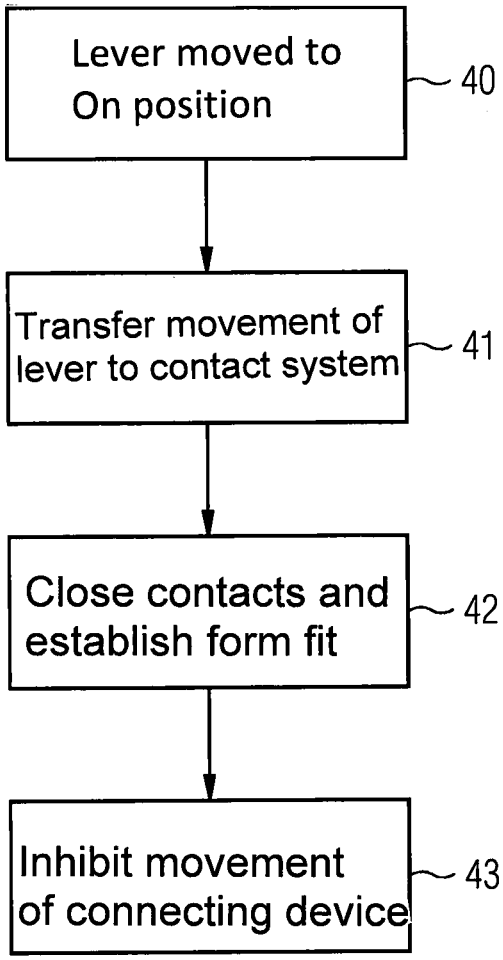
FIG. 1 a method according to an embodiment of the invention.
Figure 2:
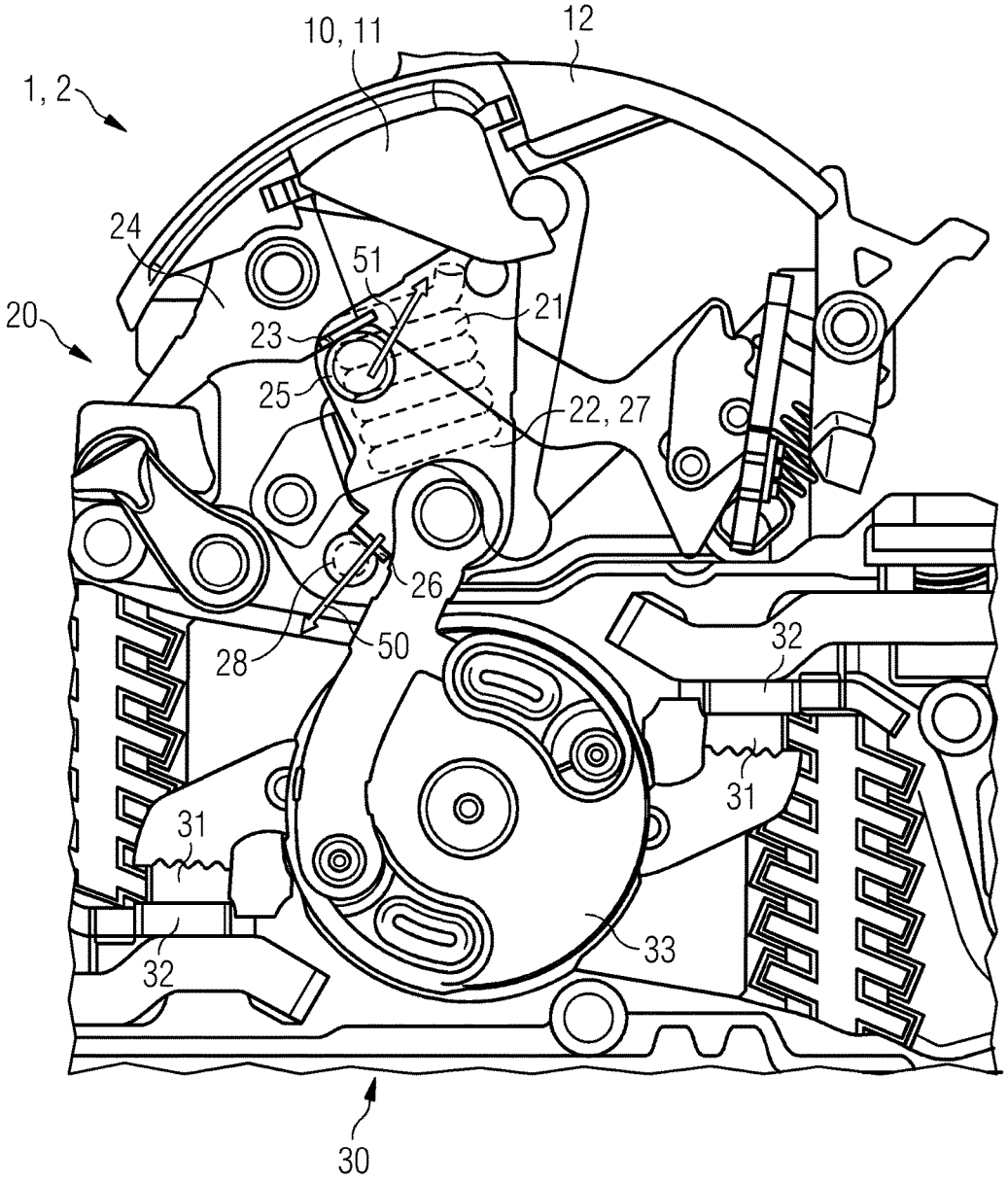
FIG. 2 a sectional view of a circuit breaker according to an embodiment of the invention.

Elements having the same functions and mode of action are provided in FIGS. 1 and 2 with the same reference signs.

DETAILED DESCRIPTION OF THE EXAMPLE EMBODIMENTS

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Further, although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

According to a first aspect of an embodiment of the invention, a method is disclosed for operating a circuit breaker. In an example embodiment of the method, the circuit breaker includes an operating lever, a latching mechanism and an electrical contact system with a movable contact and a fixed contact, wherein the operating lever is movable into an ON-position and an OFF-position, wherein further the operating lever is mechanically connected via the latching mechanism to the contact system such that when the operating lever is in its OFF-position the contacts of the electrical contact system are opened and that when the operating lever is in its ON-position the contacts of the electrical contact system are closed. The method according to an embodiment of the invention comprises:

e) moving the operating lever in its ON-position, f) transferring the movement of the operating lever via the latching mechanism to the contact system by moving a connecting device of the latching mechanism mechanically directly connected to the contact system in a first direction and thereby moving the movable contact, g) reaching the ON-position of the operating lever and closing the contacts of the contact system, and h) inhibiting a movement of the connecting device in a second direction different to the first direction.

The method according to an embodiment of the invention can be used to operate a circuit breaker with an operating lever. The operating lever or its handle section, respectively, can be operated by an operator, for instance be moved into an ON-position and an OFF-position. Inside the circuit breaker, a contact system comprising at least a movable contact and a fixed contact for the switching of the electrical current is provided. Of course, the contact system can comprise more than one pair of movable and fixed contacts. The operation lever and the contact system are both mechanically connected to a latching mechanism, the latching mechanism therefore providing a mechanical connection between the operating lever and the contact system. Especially, it can be ensured by this connection that when the operating lever is in its OFF-position the contacts of the electrical contact system are opened and that when the operating lever is in its ON-position, the contacts of the electrical contact system are closed. Of course safety devices such as for instance an overcurrent protection and/or a short-circuit protection and the according trigger switches can additionally be provided in the circuit breaker, especially as an integral part of the latching mechanism and/or the contact system. To ensure a successful operation of the circuit breaker, meaning that the contact system is being closed when the operating lever is moved into its ON-position and especially that any provided safety device is armed, a reset of the latching mechanism can be necessary.

To switch on a circuit breaker in step a) of a method according to an embodiment of the invention the operating lever is moved into its ON-position. This task can be achieved for instance by a manual actuation by an operator or by an actuation unit. This leads simultaneously to a transfer of the movement of the operating lever to the latching mechanism and further to the contact system (step b) of a method according to an embodiment of the invention). For this purpose, the latching mechanism provides a connection device, which is directly connected to the contact system. Directly connected according to embodiments of the invention can imply for instance that the connection device and the contact system are fixed on each other and therefore a movement of the connection device automatically leads to a movement of the contact system and vice versa. The movements can be for instance linear, circular or of any appropriate shape. The connection device moves in step b) in a first direction, which correspond to a movement of the contacts of the electrical contact system in a closing direction. In step c) of a method according to the invention, the operating lever reaches its ON-position. The ON-position is chosen such that the contacts of the contact system are closed once the operating lever reaches its ON-position.

As soon as the contacts of the electrical contact system are closed, electrical current flows through the circuit breaker and the downstream electrical circuit. An unintentional interruption of this flow, for instance caused by an unintentional triggering of a safety device, can lead to damage to a consumer load in the downstream electrical circuit. To prevent such an interruption, in step d) of an method according to an embodiment of the invention, a movement of the connection device in a second direction different to the first direction is being inhibited. As already mentioned, a movement of the connection device would automatically lead to a movement of the contacts of the electrical contact system. Especially, when the connection device would be moved in a second direction different to the first direction, the contacts would be moved in a direction different to the closing direction and therefore lead to an opening of the contact system.

By inhibiting a movement of the connecting device automatically an unintentional movement of the contacts of the electrical contact system can be inhibited. Directly inhibiting the contact device is therefore an especially easy way to prevent an unintentional opening of the contacts of the contact system. Of course, an intentional opening of the contact system, for instance initiated by an actuation of the operating lever by an operator or a trigger switch of a safety device, is still possible.

No complex load balancing, for instance including long lever arms or similar elements, is needed, as it is for instance necessary when springs acting on the latching mechanisms and/or the safety devices are used. Further, the safety devices can be available armed from a beginning of the operation of the circuit breaker. The overall safety of a circuit breaker which is operated using a method according to an embodiment of the invention can be improved. In addition, a compact design of the circuit breaker is made possible.

Further, in a method according to an embodiment of the invention, step d) includes inhibiting a movement of the connecting device in the first direction. Thereby, also the movement of the connection device, which leads to the closure of the electrical contact system, is stopped. The connection device can therefore be blocked in its position at the end of its movement. No additional force is transferred from the connection device to the electrical contact system to press the contacts of the contact system together after the closure of the contacts in step c). This is especially advantageous in case of a triggering of a safety device because for an opening of the contacts of the electrical contact system, no additional force exerted from the connection device has to be overcome. The opening of the contacts by the according safety device can therefore be done faster. Thereby the overall safety of a circuit breaker, which is operated using a method according to an embodiment of the invention can be further improved.

In addition, a method according to an embodiment of the invention can be improved by that the second direction is opposite to the first direction. By this, a movement of the connection device in the second direction would be reversal of the movement of the connection device in the first direction. An unintentional reversal of the movement of the connection device, which would lead to an opening of the contacts of the electrical contact system can therefore be prohibited very effectively.

In a further improvement of a method according to an embodiment of the invention, the first and the second directions are circular directions. Circular directions can for instance be achieved by mounting the connection device on a swivel. Preferably, the contacts of the electrical contact system and the connection device are mounted on the same swivel, for instance the swivel of a rotor of the electrical contact system. Such a pivot bearing is a very easy way to allow a controlled movement and to simultaneously comprise a reliable fixation.

Additionally, in a method according to an embodiment of the invention, in step d) at least one of the movements of the connecting device is inhibited by a form fit, preferably an internal form fit in the latching mechanism. A form fit is an especially easy way to hinder the movement of an object in a certain direction. In a form fit, the object to be blocked directly contacts a surface. By fixing the surface, also a movement of the object can be inhibited. Preferably both a movement in second direction and a movement in the first direction respectively are inhibited by a form fit. Further, the latching mechanism itself can provide the surface(s) necessary for building the form fit. An external device is therefore not needed for building the form fit and the circuit breaker can be designed in a more compact way.

Further, according to a second aspect of an embodiment of the invention, a circuit is disclosed. The circuit comprises an operating lever, a latching mechanism and an electrical contact system with a movable contact and a fixed contact, wherein the operating lever is movable into an ON-position and an OFF-position, wherein further the operating lever is mechanically connected via the latching mechanism to the contact system such that when the operating lever is in its OFF-position, the contacts of the electrical contact system are opened and that when the operating lever is in its ON-position, the contacts of the electrical contact system are closed, the latching mechanism comprising a connecting device mechanically directly connected to the contact system, moving in a first direction when the operating lever is moved into its ON-position.

A circuit breaker according to an embodiment of the invention comprises an operating lever. The operating lever or its handle section respectively can be operated by an operator, for instance be moved into the ON-position and the OFF-position. Inside the circuit breaker, a contact system comprising at least a movable contact and a fixed contact for the switching of the electrical current is provided. Of course the contact system can comprise more than one pair of movable and fixed contacts. The operation lever and the contact system are both mechanically connected to a latching mechanism, the latching mechanism therefore providing a mechanical connection between the operating lever and the contact system. Especially, it can be ensured by this connection that when the operating lever is in its OFF-position, the contacts of the electrical contact system are opened and that when the operating lever is in its ON-position, the contacts of the electrical contact system are closed. Of course, safety devices such as for instance an overload protection and/or a short-circuit protection and the according trigger switches can additionally be provided in the circuit breaker, especially as an integral part of the latching mechanism and/or the contact system.

To ensure a successful operation of the circuit breaker, meaning that the contact system is being closed when the operating lever is moved into its ON-position and especially that any provided safety device is armed, a reset of the latching mechanism is necessary. An activation of the latching mechanism and/or an arming of any safety devices triggered by a subsequent movement of the operating lever in its ON-position can thereby be secured.

A circuit breaker according to an embodiment of the invention includes a movement of the connecting device in a second direction being inhibited when the operating lever is in its ON-position, wherein the second direction is different to the first direction. As soon as the contacts of the electrical contact system are closed, electrical current flows through the circuit breaker and the downstream electrical circuit. An unintentional interruption of this flow, for instance caused by an unintentional triggering of a safety device, can lead to damage to a consumer load in the downstream electrical circuit.

To prevent such an interruption in a circuit breaker according to an embodiment of the invention, a movement of the connection device in a second direction different to the first direction is inhibited. Such a movement of the connecting device in a second direction different to the first direction would lead to a movement of the contacts in a direction different to the closing direction and therefore lead to an opening of the contact system.

By inhibiting a movement of the connecting device automatically an unintentional opening of the contacts of the electrical contact system can be inhibited. This is an especially easy way to prevent an unintentional opening of the contacts of the contact system. Of course, an intentional opening of the contact system, for instance initiated by an actuation of the operating lever by an operator or a trigger switch of a safety device, is still possible.

No complex load balancing, for instance including long lever arms or similar elements, is needed, as it is for instance necessary when springs acting on the latching mechanisms and/or the safety devices are used. Further the safety devices can be available armed from a beginning of the operation of the circuit breaker. The overall safety of a circuit breaker which is operated using a method according to an embodiment of the invention can be improved. In addition, a compact design of the circuit breaker is made possible.

Further, a circuit breaker according to an embodiment of the invention includes the circuit breaker being enabled to carry out a method according to the first aspect of an embodiment of the invention. By carrying out such a method a circuit breaker provides the same advantages, which have been discussed in detail according to a method for operating a circuit breaker according to the first aspect of an embodiment of the invention.

In an additional embodiment of a circuit breaker according to an embodiment of the invention, a movement of the connecting device in the first direction is inhibited when the operating lever is in its ON-position. This results in combination with the inhibition of a movement of the connecting device in the second direction in a blockage of the connection device in its position at the end of its movement. When the connection device is moved in the first direction the contacts of the electrical contact system are moved in their closing direction. As soon as the operating lever is in its ON-position, the contacts of the electrical contact system are closed.

An inhibition of a movement of the connection device in its first direction also inhibits a further movement of the contacts of the electrical contact system in their closing direction. No additional force is transferred from the connection device to the electrical contact system to press the contacts of the contact system together. This is especially advantageous in case of a triggering of a safety device because for an opening of the contacts of the electrical contact system, no additional force exerted from the connection device has to be overcome. The opening of the contacts by the according safety device can therefore be done faster. Thereby, the overall safety of a circuit breaker, which is operated using a method according to an embodiment of the invention, can be further improved.

Further, a circuit breaker according to an embodiment of the invention includes the latching mechanism comprising at least one touching surface, wherein the at least one touching surface and the connecting device establish a form fit and thereby inhibit the movement of the connecting device in the first and/or second direction when the operating lever is in its ON-position. A form fit is an especially easy way to inhibit a movement of an object in a certain direction. The touching surface as a preferably fixed or at least fixable part of the latching mechanism is in addition a very simple way to establish such a form fit. When the operating lever is in its ON-position, the touching surface contacts the connection device and thereby a form fit is established. The touching surface is arranged such that a movement of the connection device in the second direction is blocked by the touching surface. Naturally, a second touching surface can be present to inhibit a movement of the connecting device in another direction, preferably in the first direction. Thereby a blocking of the connection device can be reached very easily.

Additionally, a circuit breaker according to an embodiment of the invention includes an actuation unit driving the operation lever and/or the latching mechanism. An automatic and/or remote operation of the circuit breaker can thereby be provided. Especially, an application of a circuit breaker according to an embodiment of the invention in a hazardous environment and/or environments without a direct accessibility can be provided.

In FIG. 1, a method according to an embodiment of the invention is shown. FIG. 2 shows a possible embodiment of a circuit breaker 1 according to an embodiment of the invention. In the following, the two figures are described together with reference to the particular figure if applicable.

A circuit breaker 1 according to an embodiment of the invention comprises an operating lever 10. A handle 12 of the operating lever 10 can be accessed by an operator and can be manually operated. In the interior of the circuit breaker 1, the operating lever 10 is mechanically connected to a latching mechanism 20. The latching mechanism 20 is further mechanically connected to an electrical contact system 30.

In the embodiment shown the electrical contact system 30 comprises several pairs of movable 31 and fixed contacts 32. The contacts 31, 32 are mounted at a rotor 33. The mechanical connections between the operating lever 10 and the latching mechanism 20 and the electrical contact system 30 respectively are established such that when the operating lever 10 is in its OFF-position, the contacts 31, 32 of the electrical contact system 30 are opened and that when the operating lever 10 is in its ON-position 11, the contacts 31, 32 of the electrical contact system 30 are closed by a correspondent rotation of the rotor 33 of the electrical contact system 30. For this purpose, the latching mechanism 20 comprises several mechanical elements of which tension lever 24, a mechanical stop as a riveting bolt 25, an upper toggle lever 27, another mechanical stop as a distance bolt 28 and a spring element 21 are exemplarily shown.

In step a) 40 of a method according to an embodiment of the invention, the operating lever 10 is moved into its ON-position 11 as it is shown in FIG. 2. This can be done for instance either by a manually carrying out by an operator or by an actuation unit mechanically connected to the operating lever 10. According to an embodiment of the invention, it is provided in step b) 41 that the movement of the operating lever 10 is transferred to the electrical contact system 30 such that the contacts 31, 32 are closed. For this purpose, the latching mechanism 20 is mechanically connected both to the operating lever 10 and the electrical contact system 30. The latching mechanism 20 comprises a connection device 22, in the embodiment shown composed of the upper toggle lever 27, mechanically directly connected to the electrical contact system 30. During the movement of the operating lever 10 in its ON-position 11, the connecting device 22 moves in a first direction 50 and transfers this movement to the contact system 30 such that the contacts 31, 32 are closed as soon as the operating lever 10 reaches its ON-position 11 (step c) 42).

In the embodiment of a circuit breaker 1 according to an embodiment of the invention shown in FIG. 2, the tension lever 24 comprises a first touching surface 23 and the distance bolt comprises a second touching surface 26. During step c) 43, the latching mechanism 20 internally moves such that the first 23 and second touching surfaces 26 are establishing a form fit with the connecting device 22 when reaching step d) 43 of the method according to an embodiment of the invention. A movement of the connecting device 22 in the first 50 and second direction 51 is thereby inhibited. No complex load balancing, for instance including long lever arms or similar elements for the latching mechanism 20, is needed.

In doing, so an unintentional opening of the contacts 31, 32 of the electrical contact system 30 caused by the connecting device 22 and also a force acting on the electrical contact system 30 and pressing the contacts 31, 32 together can be prohibited. Of course, an intentional opening of the contacts 31, 32 of the electrical contact system 30, for instance initiated by an actuation of the operating lever 10 by an operator or a trigger switch of a safety device (not shown), is still possible. Due to the absence of the avoided force mentioned above an opening of the contacts 31, 32 by a safety device can be realised and with less expenditure of energy and is therefore faster. Also, the safety devices (not shown) are available armed from a beginning of the operation of the circuit breaker 1. The overall safety of a circuit breaker 1 according to an embodiment of the invention can be improved. In addition, a compact design of the circuit breaker 1 is made possible.

The aforementioned description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods. Further, elements and/or features of different example embodiments may be combined with each other and/or substituted for each other within the scope of this disclosure and appended claims.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Still further, any one of the above-described and other example features of the present invention may be embodied in the form of an apparatus, method, system, etc. For example, of the aforementioned methods may be embodied in the form of a system or device, including, but not limited to, any of the structure for performing the methodology illustrated in the drawings.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE SIGNS

1 Circuit breaker
2 Actuation unit
10 Operating lever
11 ON-position
12 Handle
20 Latching mechanism

21 Spring element
22 Connection device
23 First touching surface
24 Tension lever
25 Riveting bolt
26 Second touching surface
27 Toggle lever
28 Distance bolt
30 Electrical contact system
31 Movable contact
32 Fixed contact
33 Rotor
40 Step a)
41 Step b)
42 Step c)
43 Step d)
50 First direction
51 Second direction

What is claimed is:

1. A method for operating a circuit breaker, the circuit breaker including an operating lever, a latching mechanism and an electrical contact system with a movable contact and a fixed contact, the operating lever being movable into an ON-position and being mechanically connected via the latching mechanism to the electrical contact system such that when the operating lever is in the ON-position, the movable and fixed contacts of the electrical contact system are closed, the method comprising:

moving the operating lever in the ON-position;

transferring the movement of the operating lever via the latching mechanism to the contact system by moving a connecting device of the latching mechanism, mechanically directly connected to the contact system in a first direction, and thereby moving the movable contact;

reaching the ON-position of the operating lever and closing the movable and fixed contacts of the contact system; and inhibiting a movement of the connecting device in a second direction, different from the first direction by bringing a touching surface of a tension lever into direct contact with a first stationary mechanical stop and bringing a surface of the connecting device into direct contact with a touching surface of a second stationary mechanical stop thereby preventing opening of the movable and fixed contacts.

2. The method of claim 1, wherein the inhibiting includes inhibiting a movement of the connecting device in the first direction.

3. The method of claim 1, wherein the second direction is opposite to the first direction.

4. The method of claim 1, wherein the first and the second direction are circular directions.

5. The method of claim 1, wherein, in the inhibiting, at least one of the movements of the connecting device is inhibited by contact of the touching surfaces with the connecting device.

6. The method of claim 2, wherein, in the inhibiting, at least one of the movements of the connecting device is inhibited by contact of the touching surfaces with the connecting device.

7. The method of claim 1, wherein, inhibiting movement of the connecting device in the second direction includes bringing the touching surface of the tension lever into direct contact with the first stationary mechanical stop which is separate from the tension lever and the connecting device and bringing a surface of the connecting device into direct contact with the touching surface of the second stationary mechanical stop which is separate from the tension lever and the connecting device thereby preventing opening of the movable and fixed contacts.

8. The method of claim 1, wherein the first and second stationary mechanical stops are bolts.

* * * * *